US006939167B2

(12) United States Patent
Kosuge

(10) Patent No.: US 6,939,167 B2
(45) Date of Patent: Sep. 6, 2005

(54) BATTERY CONNECTING MEMBER AND METHOD OF MOUNTING IT TO A BATTERY

(75) Inventor: Shuji Kosuge, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/726,940

(22) Filed: Dec. 3, 2003

(65) Prior Publication Data

US 2004/0132335 A1 Jul. 8, 2004

(30) Foreign Application Priority Data

Dec. 3, 2002 (JP) ..... 2002-351130

(51) Int. Cl.[7] ..... H01R 13/52
(52) U.S. Cl. ..... 439/522
(58) Field of Search ..... 439/522, 121, 439/65, 76.1, 76.2; 337/187–189, 208, 260, 267; 361/104, 626, 642

(56) References Cited

U.S. PATENT DOCUMENTS 5,034,620 A * 7/1991 Cameron ..... 307/10.7
5,643,693 A * 7/1997 Hill et al. ..... 429/121
5,645,448 A 7/1997 Hill
6,512,443 B1 * 1/2003 Matsumura et al. ..... 337/189

FOREIGN PATENT DOCUMENTS

JP 63-182048 7/1988

* cited by examiner

*Primary Examiner*—Alexander Gilman
(74) *Attorney, Agent, or Firm*—Gerald E. Hespos; Anthony J. Casella

(57) ABSTRACT

A battery-connecting member (1) has a base (2) for accommodating a fuse (10) and a casing (3) for accommodating the base (2). The base (2) includes a battery terminal (7), busbars (8A, 8B) and the fuse (10). A box-accommodating portion (15) is provided in the casing (3) for accommodating the fuse (10) and is provided with an operation space closing portion (17) at a side toward which the fuse (10) is detached. Thus, the fuse (10) cannot be detached unless the battery-connecting member (1) is detached from a battery (5) and the casing (3) and the base (2) are separated.

5 Claims, 5 Drawing Sheets

BATTERY CONNECTING MEMBER AND METHOD OF MOUNTING IT TO A BATTERY

BACKGROUND OF THE INVENTION

1. Field of the Invention

The present invention relates to a battery-connecting member and to a method of mounting a battery-connecting member to a battery.

2. Description of the Related Art

Japanese Unexamined Utility Model Publication No. S63-182048 and FIGS. 5 and 6 herein show a battery-connecting member. With reference to FIGS. 5 and 6, a battery-connecting member 100 has a battery terminal 101 coupled to a busbar 102. Fuses 103 are connected with the busbar 102 and a casing 104 accommodates the battery terminal 101, the busbar 102 and the fuses 103. The battery terminal 101 is mounted to a battery post 105 of a battery 106. Additionally, a cover 107 is provided integrally on the casing 104 via a hinge and can be rotated into a position for covering the fuses 103.

The battery-connecting member 100 may be connected with the battery 106 of an automotive vehicle to connect a plurality of circuits (e.g. a power circuit connected with a cell motor, circuits for devices connected with other electric devices, etc.).

The fuses 103 may have to be replaced for maintenance or other reasons after the battery-connecting member 100 is connected with the battery post 105. In such a case, the battery terminal 101 is detached from the battery post 105 so that the entire battery-connecting member 100 is disconnected electrically from the battery 106. The fuses 103 then are replaced.

The cover 107 of the casing 104 can be opened to access the fuses 103 of the battery-connecting member 100 while the battery terminal 101 is connected with the battery post 105. Some operators may try to replace the fuses 103 while the battery-connecting member 100 still is connected with the battery 106. However, there can be adverse effects on other electronic devices if the respective circuits are shorted at this time.

The present invention was developed in view of the above problem and an object thereof is to provide a battery-connecting member that prevents a fuse replacement without being disconnected from a battery post.

SUMMARY OF THE INVENTION

The invention is a battery-connecting member with a base that has a battery terminal for coupling to a battery post of a battery. At least one busbar is connected electrically to the battery terminal by a fuse. A casing is provided at a position closer to the battery than the base. The casing has a fuse replacement hindrance portion for hindering replacement or withdrawal of the fuse when the base is assembled to the casing. Accordingly, the fuse can be withdrawn only if the base is disassembled from the casing and disconnected electrically from the battery post. Thus, an external circuit, such as a load, cannot be damaged due to the fuse being removed while the external circuit is electrically connected to the battery.

The fuse replacement hindrance portion preferably comprises an operation space closing portion for at least partly closing an operation space for replacing the fuse.

The battery-connecting member is fixed to the battery by first mounting the fuse to the base, mounting the base to the casing, mounting the casing to the battery, and then connecting the battery terminal electrically to the battery post. The reverse of these steps is carried out to replace the fuse. Thus, the battery terminal must be disconnected electrically from the battery post before the fuse can be removed for maintenance or replacement. More particularly, the operation space closing portion requires the base to be separated from the casing to ensure sufficient operation space for replacing the fuse. Thus, short circuits cannot adversely influence other electronic devices during a fuse replacing operation.

The operation space closing portion preferably has a view enabling portion to permit visual observation of the fuse can.

The battery-connecting member may have a cover for at least partly covering the base and/or the casing from a side opposite to the battery. The cover preferably has at least one lock that is resiliently engageable with the casing and/or the base.

The base preferably comprises a battery terminal electrically connected to a first fuse-connecting portion and a second fuse-connecting portion electrically connected to the busbar. Thus, the fuse electrically connects the first and second fuse-connecting portions.

The base preferably is assembled by mounting the busbar at a specified position on the base, connecting the fuse to the two fuse-connecting portions and then mounting the base in the casing to form an integral unit.

The invention also relates to a method of assembling a battery-connecting member to a battery. The method comprises mounting a fuse to a base, assembling the base to the casing to form a battery-connecting member and then mounting the battery-connecting member to the battery. The base includes a battery terminal to be coupled to a battery post on the battery, at least one busbar, and a fuse for electrically connecting the battery terminal to the busbar. The casing comprises a fuse replacement hindrance portion that hinders the replacement of the fuse when the base is assembled to the casing.

The method may further comprise arranging a cover to at least partly cover the base and/or the casing from a side substantially opposite the battery.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 4:
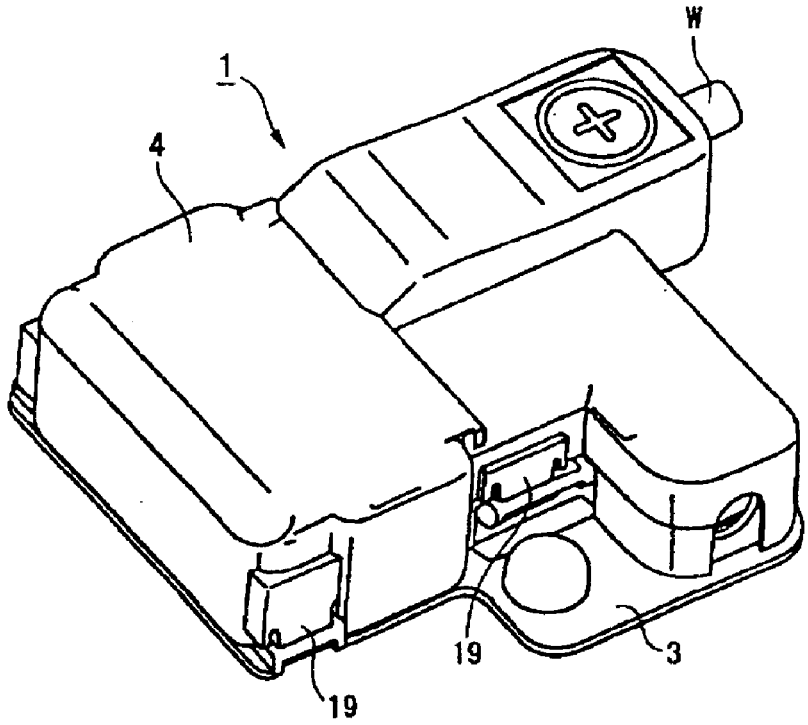
FIG. 4 is a perspective view of a battery connecting member.
Figure 5:
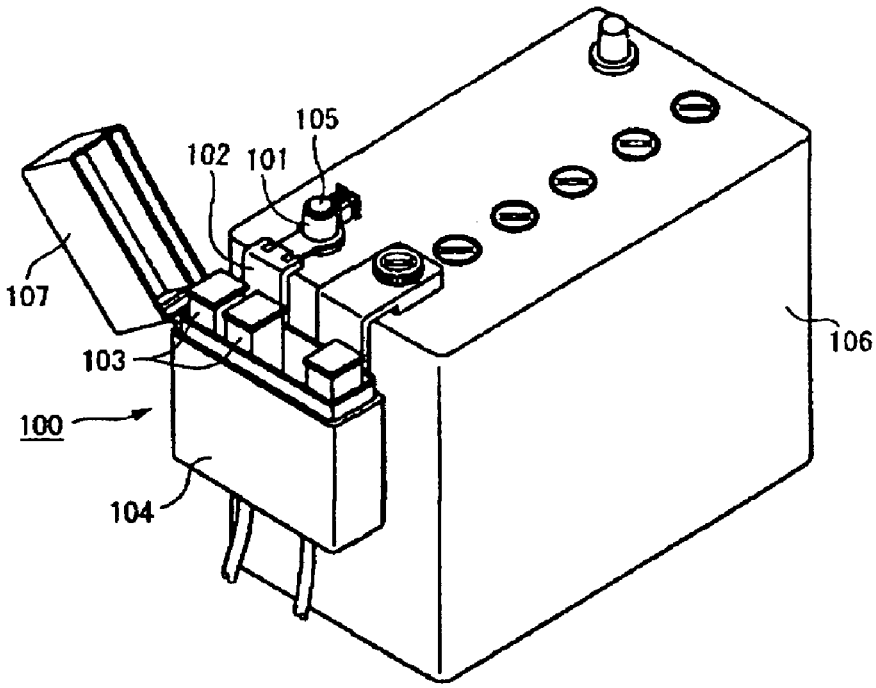
FIG. 5 PRIOR ART
FIG. 5 is a perspective view of a prior art battery-connecting member mounted on a battery.
Figure 6:
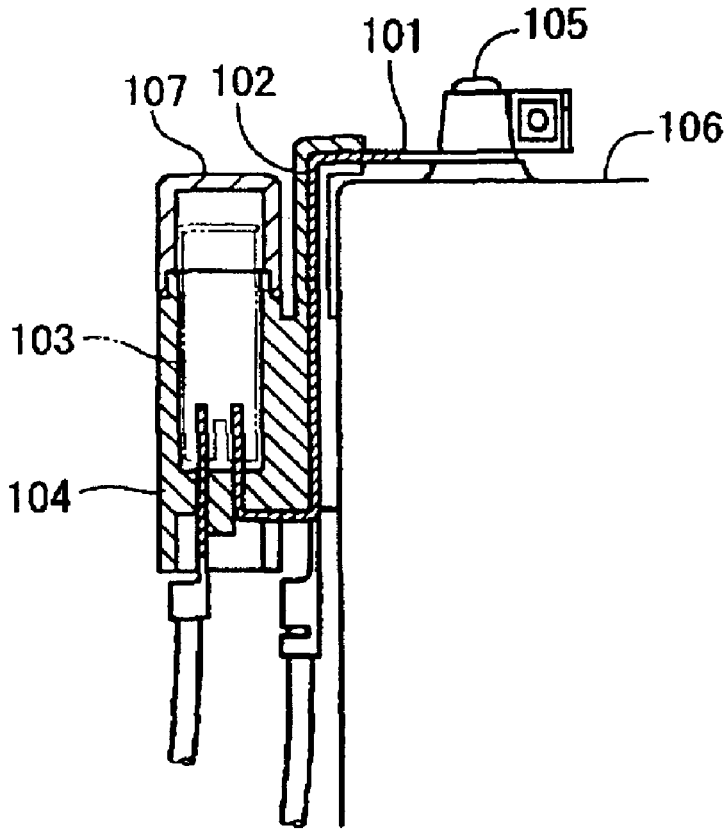
FIG. 6 PRIOR ART
FIG. 6 is a side view in section of the prior art battery-connecting member mounted on the battery.

A battery-connecting member according to the invention is identified generally by the numeral 1 in FIG. 4. The battery-connecting member 1 includes a base 2, a casing 3 and a cover 4, and is for use with a battery 5 that has a battery post 6. Thus, the battery-connecting member 1 may be used in an automotive vehicle to supply power to at least one circuit.

Figure 1:
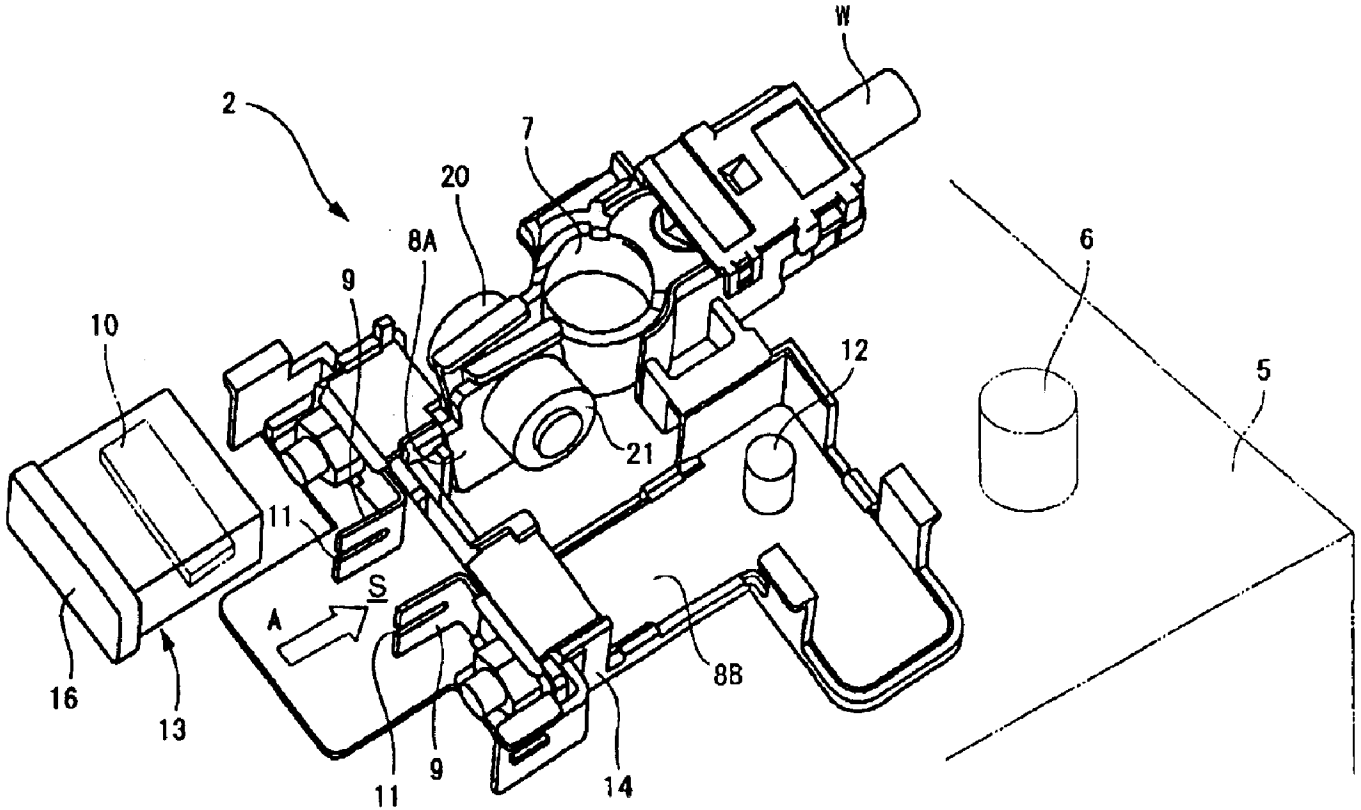
FIG. 1 is a perspective view of a base according to the invention.
Figure 2:
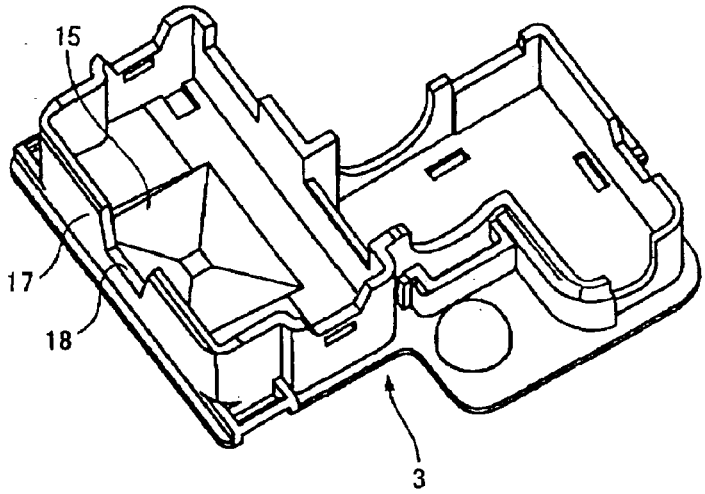
FIG. 2 is a perspective view of a casing.
Figure 3:
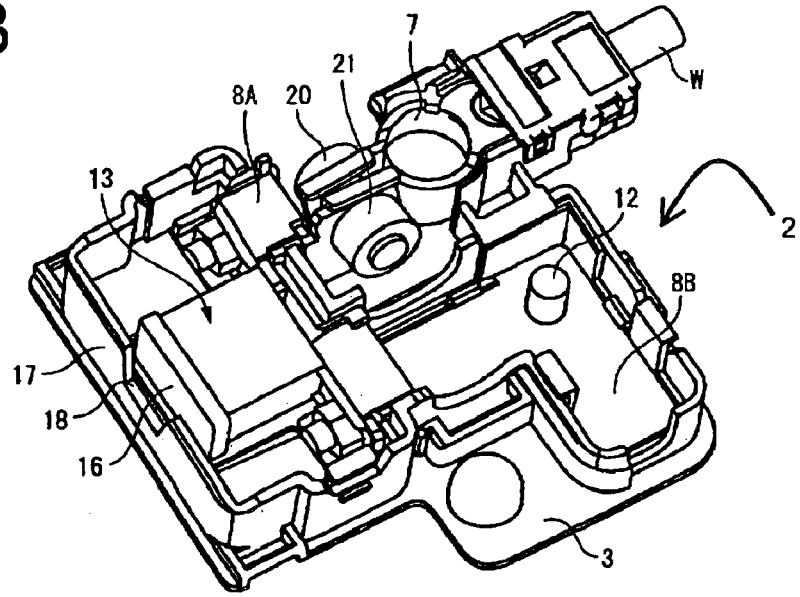
FIG. 3 is a perspective view of the assembled base and the casing.

The base 2 is shown in FIG. 1 and includes a battery terminal 7 to be coupled to the battery post 6 on the battery 5, busbars 8A, 8B and a base body 14 to position the respective members of the base 2.

A wire W is to be connected with one end of the battery terminal 7 to supply power to one circuit. A bolt 20 and a nut 21 are assembled to the battery terminal 7 and enable the battery terminal 7 to be fixed to the battery post 6.

Two fuse connectors 9 are provided at opposed ends of each of the two busbars 8A, 8B. A fuse mounting groove 11 is formed at the leading end of each fuse connector 9 and can receive a fuse 10. The fuse mounting grooves 11 open substantially obliquely towards the battery 5 and down to the left in FIG. 1. Thus, the fuse 10 is mounted in the direction of the arrow A of FIG. 1, and an operation space S is defined before the leading ends of the fuse mounting grooves 11 of the fuse connectors 9. A terminal-mounting portion 12 projects from the busbar 8B, and an unillustrated terminal can be mounted on the terminal-mounting portion 12 to supply power to another circuit.

The fuse 10 is provided integrally in a fuse box 13, and the fuse box 13 is replaced when the fuse 10 is replaced. The fuse box 13 has a window or substantially transparent portion 16 at a side of the operation space and through which the fuse 10 can be seen.

The casing 3 is formed of, e.g. a synthetic resin and can receive the base 2. Additionally, the casing 3 is mounted on the battery 5 so that at least part of the casing 3 is sandwiched between the battery 5 and the base 2. A box-accommodating portion 15 is provided at a section in the casing 3 where the fuse box 13 is to be accommodated. An operation space closing wall 17 is provided at a side of the box-accommodating portion 15 from which the fuse box 13 engages the fuse connector 9 (i.e. at the side of the operation space S). Thus, the fuse box 13 cannot be replaced or withdrawn while the casing 3 and the base 2 are assembled. The operation space closing wall 17 has a window 18 so that the fuse 10 can be seen through the transparent portion 16.

The cover 4 is assembled from above the base 2, and hence from a side substantially opposite the battery 5. The cover 4 is configured to cover substantially the entire base 2 after the base 2 and the casing 3 are assembled. The cover 4 has a locking piece 19 resiliently engageable with the casing 3.

The battery-connecting member 1 is assembled by first mounting the busbars 8A, 8B at specified positions on the base body 14. The fuse box 13 then is mounted so that the fuse 10 fits into the fuse mounting grooves 11 of the two fuse connectors 9. Further, the battery terminal 7 connected with the end of the wire W is fixed to the busbar 8A. The base 2 then is mounted in the casing 3 to form the battery-connecting member 1.

The battery terminal 7 is mounted on the battery post 6 and the bolt 20 and the nut 21 are tightened to fix the battery-connecting member 1 to the battery 5. Finally, the cover 4 is mounted to cover the base 2, thereby completing the mounting of the battery-connecting member 1.

The fuse 10 can be replaced by detaching the cover 4 from the base 2 and the casing 3. Here, the operation space closing wall 17 prevents the fuse box 13 from being detached from the base 2 while the base 2 and the casing 3 are assembled. Thus, the base 2 and the casing 3 must be separated to access the fuse box 13. Accordingly, the bolt 20 and the nut 21 are loosened to cancel the fixed state of the battery post 6 and the battery terminal 7.

The base 2 and the casing 3 then are detached from the battery 5 so that the busbars 8A, 8B of the base 2 are disconnected electrically from the battery 5. The base 2 then is separated from the casing 3 and fuse box 13 is pulled toward the operation space S in a direction opposite from the arrow A of FIG. 1 to detach the fuse 10 from the busbars 8A, 8B. A fuse 10 of a new fuse box 13 then is fit into the fuse mounting grooves 11, and the battery-connecting member 1 is reassembled and fixed to the battery 5 again as described-above. The order of the steps carried out for replacing the fuse 10 can be varied slightly by separating the base 2 from both the casing 3 and the battery 5 without first separating the casing 3 from the battery 5. However, with both of these options, the base 2 is disconnected electrically from the battery post 6 before removing the fuse 10 from the fuse connectors 9.

The fuse box 13 and at least portions of the base 2 are surrounded at least partly by the operation space closing wall 17 of the casing 3. Therefore, the casing 3 and the base 2 must be separated to ensure sufficient operation space for replacing the fuse 10. Accordingly, there is no possibility that short circuits will adversely affect other electronic devices while a fuse 10 is being replaced.

What is claimed is:

1. A battery-connecting member comprising:

a casing configured for mounting on a battery in proximity to a battery post of the battery, the casing including a fuse accommodating space defined at least partly by a wall; and a base removably mounted to the casing, the base including a battery terminal configured for releasable connection to the battery post, at least one busbar with a fuse connector disposed in the fuse accommodating space, the fuse connector having at least one fuse receiving groove opening toward the wall and configured for replaceably receiving a fuse along a direction aligned to intersect the wall, the fuse connector being spaced from the wall a distance selected to require removal of the base from the casing to replace the fuse.

2. The battery connecting member of claim 1, wherein the comprises a view-enabling portion so that the fuse can be seen therethrough.

3. The battery-connecting member of claim 1, wherein the fuse connector of the busbar is a first fuse connector, and wherein the battery terminal has a second fuse connector, wherein the first and second fuse connectors are electrically connectable by the fuse.

4. The battery-connecting member of claim 1, further comprising a cover for at least partly covering the base and the casing from a side substantially opposite the battery.

5. The battery connecting member of claim 4, wherein the cover has at least one locking piece resiliently engageable with at least one of the casing and the base.

* * * * *